US008870986B2

(12) United States Patent
Papin et al.

(10) Patent No.: US 8,870,986 B2
(45) Date of Patent: Oct. 28, 2014

(54) BONDED ABRASIVE BODY AND METHOD OF FORMING SAME

(71) Applicants: Sophie Papin, Villeneuve-la-Garenne (FR); Cécile Jousseaume, Asnières-sur-Seine (FR); Nilanjan Sarangi, Shrewsbury, MA (US); Sandhya Jayaraman Rukmani, Worcester, MA (US)

(72) Inventors: Sophie Papin, Villeneuve-la-Garenne (FR); Cécile Jousseaume, Asnières-sur-Seine (FR); Nilanjan Sarangi, Shrewsbury, MA (US); Sandhya Jayaraman Rukmani, Worcester, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 0 days.

(21) Appl. No.: 13/930,147

(22) Filed: Jun. 28, 2013

(65) Prior Publication Data

US 2014/0007516 A1 Jan. 9, 2014

Related U.S. Application Data

(60) Provisional application No. 61/666,066, filed on Jun. 29, 2012.

(51) Int. Cl.

| | |
|---|---|
| ***B24D 3/14*** | (2006.01) |
| ***C09K 3/14*** | (2006.01) |
| ***C04B 35/111*** | (2006.01) |
| ***C04B 35/10*** | (2006.01) |

(52) U.S. Cl.

CPC ..... *B24D 3/14* (2013.01)
USPC ..... 51/307; 51/293

(58) Field of Classification Search

CPC ..... B24D 3/02; B24D 3/04; B24D 3/14; C04B 35/10; C04B 35/111; C09K 3/14
See application file for complete search history.

(56) References Cited

U.S. PATENT DOCUMENTS

| | | | | |
|---|---|---|---|---|
| 2,413,549 | A | 12/1946 | Deyrup | |
| 2,477,649 | A | 8/1949 | Pincus | |
| 2,527,884 | A | 10/1950 | Kaufmann et al. | |
| 4,150,514 | A | 4/1979 | Douglass | |
| 4,305,898 | A | 12/1981 | Obersby | |
| 4,404,003 | A | 9/1983 | Harris | |
| 4,541,842 | A | 9/1985 | Rostoker | |
| 4,543,107 | A | 9/1985 | Rue | |
| 4,898,597 | A | 2/1990 | Hay et al. | |
| 4,997,694 | A | 3/1991 | Legare | |
| 5,095,665 | A | 3/1992 | Nagata et al. | |
| 5,203,886 | A | 4/1993 | Sheldon et al. | |
| 5,401,284 | A | 3/1995 | Sheldon et al. | |
| 5,536,283 | A | 7/1996 | Sheldon et al. | |
| 5,653,775 | A | 8/1997 | Plovnick et al. | |
| 5,863,308 | A | 1/1999 | Qi et al. | |
| 6,056,794 | A | 5/2000 | Stoetzel et al. | |
| 6,093,225 | A | 7/2000 | Itoh | |
| 6,102,789 | A | 8/2000 | Ramanath et al. | |
| 6,277,161 | B1 | 8/2001 | Castro et al. | |
| 6,551,366 | B1 | 4/2003 | D'Souza et al. | |
| 6,562,089 | B1 | 5/2003 | Iwai et al. | |
| 6,609,963 | B2 | 8/2003 | Li et al. | |
| 6,620,214 | B2 | 9/2003 | McArdle et al. | |
| 6,679,758 | B2 | 1/2004 | Bright et al. | |
| 6,702,650 | B2 | 3/2004 | Adefris | |
| 6,702,867 | B2 | 3/2004 | Carman et al. | |
| 6,805,620 | B2 | 10/2004 | Iwai et al. | |
| 6,881,483 | B2 | 4/2005 | McArdle et al. | |
| 6,887,287 | B2 * | 5/2005 | Li et al. | 51/293 |
| 6,913,824 | B2 | 7/2005 | Culler et al. | |
| 7,281,970 | B2 | 10/2007 | Endres et al. | |
| 7,415,841 | B2 | 8/2008 | Kudoh et al. | |
| 7,722,691 | B2 | 5/2010 | Orlhac et al. | |
| 7,935,158 | B2 | 5/2011 | Querel et al. | |
| 8,043,393 | B2 | 10/2011 | Querel et al. | |
| 8,070,556 | B2 | 12/2011 | Kumar et al. | |
| 2008/0222967 | A1 * | 9/2008 | Querel et al. | 51/308 |
| 2011/0131888 | A1 * | 6/2011 | Querel et al. | 51/308 |
| 2011/0183142 | A1 | 7/2011 | Gebhardt | |

OTHER PUBLICATIONS

International Search Report for PCT/US2013/048478 dated Sep. 24, 2013, 3 pgs.

* cited by examiner

*Primary Examiner* — Pegah Parvini
(74) *Attorney, Agent, or Firm* — Abel Law Group, LLP; Joseph P. Sullivan

(57) ABSTRACT

An abrasive article including a bonded abrasive body having abrasive particles contained within a bond material, the bond material including a vitreous material formed from a mixture having aluminum oxide ($Al_2O_3$), bismuth oxide ($Bi_2O_3$), and boron oxide ($B_2O_3$), and wherein the mixture includes an amount (wt %) of aluminum oxide less than an amount (wt %) of bismuth oxide and the amount (wt %) of aluminum oxide is less than an amount (wt %) of boron oxide.

10 Claims, 4 Drawing Sheets

BONDED ABRASIVE BODY AND METHOD OF FORMING SAME

FIELD OF THE DISCLOSURE

The following is directed to a bonded abrasive body, and particularly, a bonded abrasive body having a vitreous bond suitable for use with microcrystalline alumina abrasive particles.

DESCRIPTION OF THE RELATED ART

Abrasive tools are generally formed to have abrasive grains contained within a bond material for material removal applications. Superabrasive grains (e.g., diamond or cubic boron nitride (CBN)) or seeded (or even unseeded) sintered sol gel alumina abrasive grain, also referred to microcrystalline alpha-alumina (MCA) abrasive grain, can be employed in such abrasive tools. The bond material can be organic materials, such as a resin, or an inorganic material, such as a glass or vitrified material. In particular, bonded abrasive tools using a vitrified bond material and containing MCA grains or superabrasive grain are commercially useful for grinding.

Certain bonded abrasive tools, particularly those utilizing a vitrified bond material, require high temperature forming processes, oftentimes on the order of 1100° C. or greater, which can have deleterious effects on abrasive grains of MCA. In fact, it has been recognized that at such elevated temperatures necessary to form the abrasive tool, the bond material can react with the abrasive grains, particularly MCA grains, and damage the integrity of the abrasives, reducing the grain sharpness and performance properties. As a result, the industry has migrated toward reducing the formation temperatures necessary to form the bond material in order to curb the high temperature degradation of the abrasive grains during the forming process.

For example, to reduce the amount of reaction between MCA grain and vitrified bond, U.S. Pat. No. 4,543,107 discloses a bond composition suitable for firing at a temperature as low as about 900° C. In an alternate approach, U.S. Pat. No. 4,898,597 discloses a bond composition comprising at least 40% fritted materials suitable for firing at a temperature as low as about 900° C. Other such bonded abrasive articles utilizing bond materials capable of forming at temperatures near 1000° C., include U.S. Pat. No. 5,203,886, U.S. Pat. No. 5,401,284, U.S. Pat. No. 5,536,283, and U.S. Pat. No. 6,702,867. Still, the industry continues to demand improved performance of such bonded abrasive articles.

SUMMARY

According to one aspect, an abrasive article includes a bonded abrasive body comprising abrasive particles including microcrystalline alumina, the abrasive particles contained within a bond material comprising a vitreous material formed from a mixture comprising barium oxide (BaO) and silicon dioxide ($SiO_2$), wherein the mixture comprises a ratio of barium oxide to silicon dioxide ($BaO/SiO_2$) of at least about 1.2.

According to another aspect, an abrasive article includes a bonded abrasive body comprising abrasive particles contained within a bond material, the bond material comprising a vitreous material formed from a mixture comprising aluminum oxide ($Al_2O_3$), bismuth oxide ($Bi_2O_3$), and boron oxide ($B_2O_3$), wherein the mixture comprises a ratio of bismuth oxide to aluminum oxide ($Bi_2O_3/Al_2O_3$) as measured in weight percent within a range between about 1.2 and about 20.

In yet another aspect, an abrasive article includes a bonded abrasive body comprising abrasive particles contained within a bond material, the bond material comprising a vitreous material formed from a mixture including aluminum oxide ($Al_2O_3$), bismuth oxide ($Bi_2O_3$), and boron oxide ($B_2O_3$), wherein the mixture comprises an amount (wt %) of aluminum oxide less than an amount (wt %) of bismuth oxide and the amount (wt %) of aluminum oxide is less than an amount (wt %) of boron oxide.

BRIEF DESCRIPTION OF THE DRAWINGS

The present disclosure may be better understood, and its numerous features and advantages made apparent to those skilled in the art by referencing the accompanying drawings.

DETAILED DESCRIPTION

Figure 1:
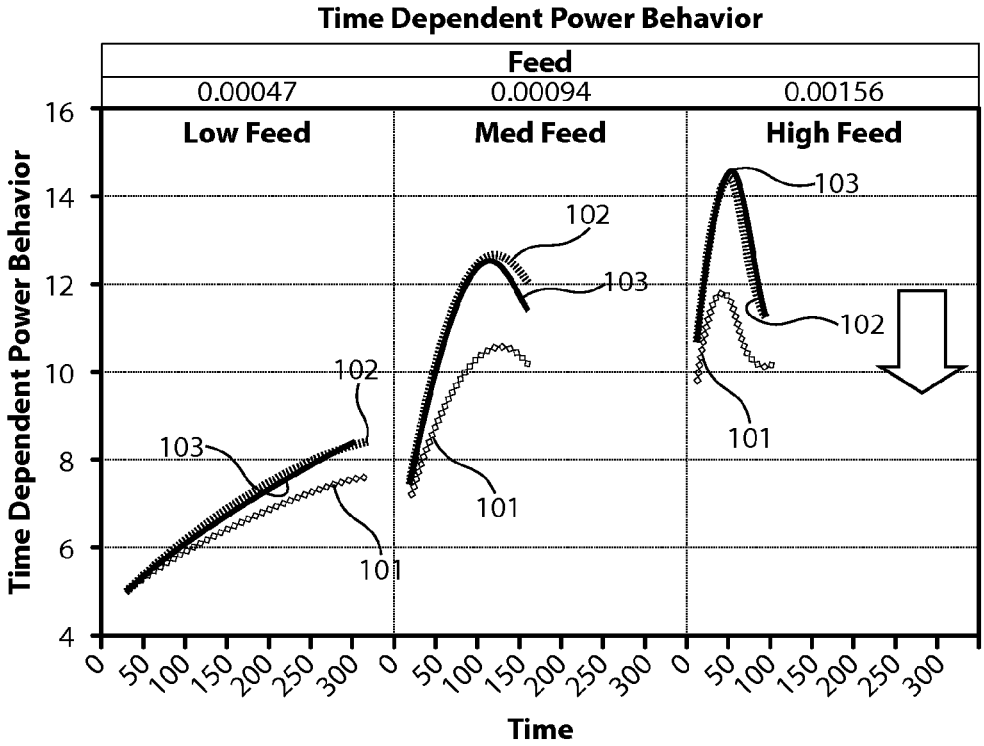
FIG. 1 includes a plot of power versus time at three different feed rates, for a conventional bonded abrasive article and abrasive articles according to embodiments.

The following is directed to bonded abrasive articles, which may be suitable for grinding and shaping of workpieces. Notably, the bonded abrasive articles of embodiments herein can incorporate abrasive particles within a bond material. Suitable applications for use of the bonded abrasive articles of the embodiments herein include grinding operations including for example, centerless grinding, cylindrical grinding, crankshaft grinding, various surface grinding operations, bearing and gear grinding operations, creepfeed grinding, and various toolroom applications.

According to an embodiment, the method of forming a bonded abrasive article of an embodiment can be initiated by forming a mixture of suitable compounds and components to form a bond material. The bond material of the embodiments herein can be formed of compounds of inorganic material, such as oxide compounds. For example, one suitable oxide material can include silicon dioxide ($SiO_2$ or silica). In accordance with an embodiment, the bond material can be formed from not greater than about 30 wt % silicon dioxide for the total weight of the bond material. In other embodiments, the content of silicon dioxide can be less, such as not greater than about 26 wt %, not greater than about 24 wt %, not greater than about 22 wt %, or even not greater than about 20 wt %.

Still, in certain embodiments the bond material may be formed from at least about 2 wt % silicon dioxide, such as on the order of at least about 4 wt %, at least about 6 wt %, at least about 8 wt %, at least about 9 wt %, or even at least about 10 wt % silicon dioxide for the total weight of the bond material. It will be appreciated that the amount of silicon dioxide can be within a range between any of the minimum and maximum percentages noted above.

The bond material can also incorporate a certain content of aluminum oxide ($Al_2O_3$). For example, the bond material can include at least about 0.2 wt % aluminum oxide for the total weight of the bond material. In other embodiments, the amount of aluminum oxide can be at least about 0.4 wt %, at least about 0.6 wt %, at least about 0.8 wt %, at least about 0.9 wt %, or even at least about 1 wt %. In certain instances, the bond material may include an amount of aluminum oxide that is not greater than about 10 wt %, not greater than about 8 wt %, not greater than about 6 wt %, not greater than about 4 wt %, or even not greater than about 3 wt % for the total weight of the bond. It will be appreciated that the amount of aluminum oxide can be within a range between any of the minimum and maximum percentages noted above.

In certain instances, the mixture used to form the bond material can include a particular amount of silicon dioxide (i.e., silica), as measured in weight percent, as compared to the amount of aluminum oxide as measured in weight percent. For example, the mixture can include a greater content of silicon dioxide as compared to the amount of alumina. According to one embodiment, the mixture can include a particular ratio ($SiO_2/Al_2O_3$) between the amount of silicon dioxide, as measured in weight percent, versus the amount of aluminum oxide, as measured in weight percent. For example, the ratio of silicon dioxide to alumina can be described by dividing the weight percent of silicon dioxide by the weight percent of aluminum oxide within the bond material. In accordance with an embodiment, the ratio of silicon dioxide to aluminum oxide in the mixture can be not greater than about 28. In other instances, the ratio of silicon dioxide to aluminum oxide can be not greater than about 26, not greater than about 24, not greater than about 22, not greater than about 20, not greater than about 18, or even not greater than about 16. Still, the mixture can be formed such that the ratio of weight percent of silicon dioxide to the weight percent of aluminum oxide can be at least about 1.2, at least about 1.5, at least about 2 at least about 2.4, at least about 2.6, at least about 3, or even at least about 3.2. It will be appreciated that the ratio of silicon dioxide to aluminum oxide can be within a range between any of the minimum and maximum values noted above.

In certain compositions, the mixture can include a greater amount of silicon dioxide (wt %) as compared to an amount of other materials (wt %), such as zinc oxide and aluminum oxide. Additionally, the mixture may be formed such that silicon dioxide is present in a minor amount, such that the mixture contains a lesser amount of silicon dioxide (wt %) as compared to other materials such as alkaline earth oxides, alkali oxides, or zinc oxide. In one particular embodiment, the mixture can include a lesser amount of silicon dioxide as compared to bismuth oxide, boron oxide, or barium oxide.

In accordance with an embodiment, the mixture, and thus the bond material, can be formed from a certain amount of boron oxide ($B_2O_3$) (wt %). For example, the bond material can incorporate not greater than about 35 wt % boron oxide for the total weight of the bond material. In other instances, the amount of boron oxide can be less, such as not greater than about 32 wt %, not greater than about 30 wt %, not greater than about 28 wt %, not greater than about 26 wt %, or even not greater than about 24 wt %. Still, the mixture can include at least about 10 wt %, such as at least about 12 wt %, at least about 14 wt %, or even at least about 15 wt %, at least about 16 wt %, at least about 18 wt %, or even at least about 20 wt % boron oxide for the total weight of the bond material. It will be appreciated that the amount of boron oxide in the mixture can be within a range between any of the minimum and maximum percentages noted above.

In accordance with one embodiment, the mixture can include a certain content of boron oxide with respect to the content of silicon dioxide. For example, the mixture may include a greater content of boron oxide, as measured in weight percent of the total weight of the mixture, as compared to the amount of silicon dioxide, measured in weight percent. In other embodiments, the mixture may contain a greater content of silicon dioxide as compared to the amount of boron oxide. More particularly, the mixture can include boron oxide and silicon dioxide in a particular ratio ($B_2O_3/SiO_2$) of at least about 0.5. For certain other mixtures, the ratio of boron oxide to silicon dioxide can be at least about 0.6, such as at least about 0.7 at least about 0.8, at least about 0.9, at least about 1, or even at least about 1.1. Still, according to one embodiment, the mixture can have a ratio of boron oxide to silicon dioxide of not greater than about 10, such as not greater than about 9, not greater than about 8, not greater than about 7, not greater than about 6, not greater than about 5, not greater than about 4, not greater than about 3, not greater than about 2.8, or even not greater than about 2.5. It will be appreciated that the ratio of boron oxide to silicon dioxide can be within a range between any of the minimum and maximum values noted above.

According to another embodiment, the mixture can contain a greater amount of boron oxide (wt %) as compared to an amount of aluminum oxide (wt %). Still, in certain other instances, the mixture may include boron oxide and aluminum oxide in a particular ratio ($B_2O_3/Al_2O_3$). For example, the ratio of boron oxide to aluminum oxide can be at least about 3, such as at least about 4, at least about 5, at least about 5.5, or even at least about 6. In one other aspect, the ratio of bismuth oxide to aluminum oxide can be not greater than about 30, such as not greater than about 26, not greater than about 24, not greater than about 22, or even not greater than about 20. It will be appreciated that the ratio of boron oxide to aluminum oxide can be within a range between any of the minimum and maximum values noted above.

The mixture can be formed to include other components, such as bismuth oxide ($Bi_2O_3$), barium oxide (BaO), zinc oxide (ZnO) and others. According to one embodiment, the amount of boron oxide (wt %) can be less than an amount of barium oxide (wt %) in the mixture. Moreover, the mixture may include a greater amount of boron oxide (wt %) as compared to an amount of zinc oxide (wt %). In other instances, the mixture can have a greater amount of boron oxide (wt %) as compared to the amount of bismuth oxide (wt %) in the mixture.

The mixture may contain a particular content of bismuth oxide ($Bi_2O_3$). For example, the mixture may contain at least about 10 wt % bismuth oxide for the total weight of the mixture. In other instances, the amount of bismuth oxide can be greater, such as at least about 12 wt %, at least about 14 wt %, or even at least about 15 wt %. Still, in another embodiment, the mixture can contain not greater than about 30 wt %, such as not greater than about 28 wt %, not greater than about 26 wt %, not greater than about 24 wt %, not greater than about 22 wt %, not greater than about 20 wt %, or even not greater than about 18 wt % bismuth oxide for the total weight of the mixture. It will be appreciated that the amount of bismuth oxide in the mixture can be within a range between any of the minimum and maximum percentages noted above.

According to one embodiment, the mixture can contain bismuth oxide and aluminum oxide in a particular ratio ($Bi_2O_3/Al_2O_3$). For example, the ratio of bismuth oxide to aluminum oxide can be at least about 1.2, such as at least about 2, at least about 3, at least about 4, at least about 4.5, at least about 5, or even at least about 5.5. In one other aspect, the ratio of bismuth oxide to aluminum oxide can be not greater than about 20, not greater than about 19, not greater than about 18, not greater than about 17, not greater than about 16, or even not greater than about 15. It will be appreciated that the ratio of bismuth oxide to aluminum oxide can be within a range between any of the minimum and maximum values noted above.

A mixture of at least one embodiment can have a particular ratio between bismuth oxide and silicon dioxide ($Bi_2O_3/SiO_2$). The ratio of bismuth oxide and silicon dioxide can be at least about 0.5, at least about 0.6, at least about 0.7, or even at least about 0.8. According to another embodiment, the ratio of bismuth oxide and silicon dioxide can be not greater than about 10, not greater than about 9, not greater than about 8, not greater than about 7, not greater than about 6, not greater than about 5, not greater than about 4, not greater than about 3, not greater than about 2.8, not greater than about 2.5, or even not greater than about 2. It will be appreciated that the ratio of bismuth oxide to silicon dioxide can be within a range between any of the minimum and maximum values noted above.

The mixture can be formed to have a lesser amount of bismuth oxide (wt %) as compared to the amount of boron oxide (wt %). Moreover, the mixture can have a lesser amount of bismuth oxide (wt %) as compared to an amount of barium oxide (wt %) in the mixture. According to yet another embodiment, the mixture can be formed to have a lesser amount of bismuth oxide (wt %) as compared to an amount of silicon dioxide (wt %). However, in an alternative composition, the mixture may have a greater amount of bismuth oxide (wt %) as compared to an amount of silicon dioxide (wt %). Further, the mixture may include other components, such as zinc oxide (ZnO) and the amount of bismuth oxide (wt %) may be greater as compared to an amount of zinc oxide (wt %).

According to another aspect, the mixture may contain a particular content of barium oxide (BaO). For example, the mixture may contain at least about 12 wt % bismuth oxide for the total weight of the mixture. In other instances, the amount of bismuth oxide can be greater, such as at least about 16 wt %, at least about 18 wt %, at least about 20 wt %, at least about 24 wt %, at least about 28 wt %, or even at least about 30 wt %. Still, in another embodiment, the mixture can contain not greater than about 48 wt %, not greater than about 45 wt %, not greater than about 42 wt %, not greater than about 40 wt %, or even not greater than about 38 wt % barium oxide for the total weight of the mixture. It will be appreciated that the amount of barium oxide in the mixture can be within a range between any of the minimum and maximum percentages noted above.

According to one embodiment, the mixture can contain barium oxide and aluminum oxide in a particular ratio ($BaO/Al_2O_3$). For example, the ratio of barium oxide to aluminum oxide can at least about 1.2, at least about 1.8, at least about 2, at least about 3, at least about 5, at least about 7, at least about 9, or even at least about 10. In one other aspect, the ratio of barium oxide to aluminum oxide can be not greater than about 40, not greater than about 38, not greater than about 36, not greater than about 34, or even not greater than about 32. It will be appreciated that the ratio of barium oxide to aluminum oxide can be within a range between any of the minimum and maximum values noted above.

A mixture of at least one embodiment can have a particular ratio between barium oxide and silicon dioxide ($BaO/SiO_2$). The ratio of barium oxide and silicon dioxide can be at least about 0.5, at least about 0.6, at least about 0.7, at least about 0.8, at least about 0.9, at least about 1, at least about 1.2, or even at least about 1.5. According to another embodiment, the ratio of barium oxide to silicon dioxide can be not greater than about 10, not greater than about 9, not greater than about 8, not greater than about 7, not greater than about 6, not greater than about 5, not greater than about 4.5, not greater than about 4.2, or even not greater than about 4. It will be appreciated that the ratio of barium oxide to silicon dioxide can be within a range between any of the minimum and maximum values noted above.

The mixture, and thus the resulting bond material, can be formed to have a lesser amount of barium oxide (wt %) as compared to an amount of silicon dioxide (wt %). However, in an alternative composition, the mixture may have a greater amount of barium oxide (wt %) as compared to an amount of silicon dioxide (wt %). Further, the mixture may include other components, such as zinc oxide (ZnO), and the amount of barium oxide (wt %) may be greater as compared to an amount of zinc oxide (wt %). Additionally, the mixture can have a greater amount of barium oxide (wt %) as compared to an amount of aluminum oxide (wt %) in the mixture.

In one aspect, the mixture may contain a particular content of zinc oxide (ZnO). For example, the mixture may contain at least about 2 wt % zinc oxide for the total weight of the mixture. In other instances, the amount of zinc oxide can be greater, such as at least about 4 wt %, at least about 6 wt %, at least about 8 wt %, at least about 9 wt %, or even at least about 10 wt %. Still, in another embodiment, the mixture can contain not greater than about 22 wt %, such as not greater than about 20 wt %, not greater than about 18 wt %, not greater than about 16 wt %, or even not greater than about 12 wt % zinc oxide for the total weight of the mixture. It will be appreciated that the amount of zinc oxide (wt %) in the mixture can be within a range between any of the minimum and maximum percentages noted above.

According to one embodiment, the mixture can contain a greater amount of zinc oxide (wt %) as compared to an amount of aluminum oxide (wt %). In yet another aspect, the mixture can include zinc oxide and aluminum oxide in a particular ratio ($ZnO/Al_2O_3$). For example, the ratio of zinc oxide to aluminum oxide can be at least about 1.2, at least about 1.5, at least about 2, at least about 2.2, at least about 2.6, at least about 3, at least about 3.2, or even at least about 3.5. In another embodiment, the ratio of zinc oxide to aluminum oxide can be not greater than about 30, not greater than about 26, not greater than about 22, not greater than about 20, not greater than about 18, not greater than about 14, or even not greater than about 12. It will be appreciated that the ratio of barium oxide to aluminum oxide can be within a range between any of the minimum and maximum values noted above.

According to one embodiment, the mixture can contain a lesser amount of zinc oxide (wt %) as compared to an amount of silicon dioxide (wt %). Alternatively, the mixture can contain a greater amount of zinc oxide (wt %) as compared to an amount of silicon dioxide (wt %).

For one embodiment, the mixture can include a particular ratio of zinc oxide to silicon dioxide ($ZnO/SiO_2$). The ratio of zinc oxide to silicon dioxide can be at least about 0.2, at least about 0.3, at least about 0.4, at least about 0.5, or even at least about 0.6. According to another embodiment, the ratio of zinc oxide to silicon dioxide can be not greater than about 5, not greater than about 4, not greater than about 3, not greater than about 2, or even not greater than about 1.8. It will be appreciated that the ratio of zinc oxide to silicon dioxide can be within a range between any of the minimum and maximum values noted above.

In accordance with an embodiment, the bond material can be formed from the mixture that includes alkali oxide compounds ($R_2O$), wherein R represents a metal selected from Group IA elements in the Periodic Table of Elements. For example, the mixture may include alkali oxide compounds ($R_2O$) such as lithium oxide ($Li_2O$), sodium oxide ($Na_2O$), potassium oxide ($K_2O$), and cesium oxide ($Cs_2O$), and a combination thereof.

The content of alkali oxide compounds ($R_2O$) may be a minority amount. For example, the mixture may have a total amount of alkali oxide compounds of not greater than about 10 wt %, such as not greater than about 8 wt %, not greater than about 6 wt %, not greater than about 4 wt %, or even not greater than about 2 wt %.

Moreover, the mixture may have not greater than 3 different alkali oxide compounds ($R_2O$). In yet other compositions, the mixture may have not greater than 2 different alkali oxide compounds or even not greater than 1 alkali oxide. According to one particular embodiment, the mixture can be essentially free of alkali oxide compounds. More particularly, the mixture may be essentially free of lithium oxide, essentially free of sodium oxide, essentially free of potassium oxide, or essentially free of cesium oxide.

In certain embodiments, the mixture may include a total amount of alkaline earth oxide compounds (RO), such as calcium oxide (CaO), magnesium oxide (MgO), barium oxide (BaO), and strontium oxide (SrO) in an amount of at least about 12 wt % for the total weight of the mixture. According to other embodiments, the amount of alkaline earth oxides in the mixture may be greater, such as at least about 16 wt %, at least about 18 wt %, at least about 20 wt %, at least about 24 wt %, at least about 28 wt %, or even at least about 30 wt %. In another embodiment, the total content of alkaline earth oxides in the mixture can be not greater than about 48 wt %, such as not greater than about 45 wt %, not greater than about 42 wt %, not greater than about 40 wt %, or even not greater than about 38 wt %. It will be appreciated that the total content of alkaline earth oxides in the mixture can be within a range between any of the minimum and maximum values noted above.

Moreover, the mixture may have not greater than 3 different alkaline earth oxide compounds. In yet other compositions, the mixture may have not greater than 2 different alkaline earth oxide compounds, or even not greater than 1 alkaline earth oxide compound. According to one particular embodiment, the mixture can be essentially free of CaO, MgO, or SrO.

In particular instances, the mixture can include a minority content of certain oxide compounds, including for example, $MnO_2$, $ZrSiO_2$, $CoAl_2O_4$, and MgO. In one embodiment, the mixture can include not greater than about 1 wt % of any of the oxide compounds of the group $MnO_2$, $ZrSiO_2$, $CoAl_2O_4$, and MgO. According to one embodiment, the mixture can be essentially free of any of the oxide compounds of the group including $MnO_2$, $ZrSiO_2$, $CoAl_2O_4$, and MgO.

In certain embodiments, the mixture may include not greater than about 3.0 wt % phosphorous oxide ($P_2O_5$). According to a particular embodiment, the mixture may be essentially free of phosphorous oxide.

In addition to the bond material, the mixture may include abrasive particles. In certain instances, the mixture used to form the bonded abrasive article can include a combination of different types of abrasive particulate material, including for example, a combination of unagglomerated abrasive particles and abrasive agglomerates. The unagglomerated abrasive particles can be distinct and separate particulate material from abrasive agglomerates. The unagglomerated abrasive particles can be individual abrasive particles defining a crystalline or polycrystalline material. The abrasive agglomerates can be an aggregate of abrasive particles bonded together and contained within a binder.

The unagglomerated abrasive particles can include an oxide, a carbide, a nitride, a boride, an oxynitride, an oxycarbide, and a combination thereof. The abrasive particles can be a superabrasive material. One exemplary oxide material suitable for use in the unagglomerated abrasive particles is alumina. According to a particular embodiment, the unagglomerated abrasive particles can consist essentially of alumina, and more particularly, consist essentially of microcrystalline alumina.

The abrasive particles can have an average particle size that is not greater than about 250 microns. In other embodiments, the average particle size of the abrasive particles can be less, such as on the order of not greater than 225 microns, not greater than about 200 microns, not greater than about 180 microns, or even not greater than about 150 microns. Still, the average particle size of the abrasive particles can be at least about 1 micron, such as at least 5 microns, at least about 10 microns, at least about 20 microns, at least about 30 microns, or even at least about 50 microns. It will be appreciated that the average particle size of the abrasive particles can be in a range between any of the minimum and maximum values noted above.

In further reference to the abrasive particles made of microcrystalline alumina, it will be appreciated that microcrystalline alumina can be formed of grains (i.e., crystallite) having an average grain size that is sub-micron sized. In fact, the average grain size of microcrystalline alumina can be not greater than about 1 micron, such as not greater than about 0.5 microns, not greater than about 0.2 microns, not greater than about 0.1 microns, or even not greater than about 0.08 microns. Still, in one instance, the average grain size can be at least about 0.01 microns. It will be appreciated that the average grain size of the abrasive particles made of microcrystalline alumina can be in a range between any of the minimum and maximum values noted above.

Additionally, the mixture may include one or more additives. Some suitable additives can include inorganic materials, which are distinct from the other materials in the mixture, including, for example, oxides. According to one embodiment, the additives can include crystalline or amorphous phases of zirconia, silica, titania, and a combination thereof.

In certain instances, the additive can include one or more pore forming agents. Some suitable pore forming agents can include organic materials, natural materials, polymer materials, inorganic materials, and a combination thereof. According to one embodiment, the body can be formed from one or more pore forming agents such as bubble alumina, bubble mullite, hollow glass spheres, hollow ceramic spheres, hollow polymer spheres, polymers, organic compounds, fibrous materials, naphthalene, para-dichlorobenzene (PDB), shells, wood, and a combination thereof. In more particular instances, the bonded abrasive body can be formed from a combination of at least about 2 different pore forming agents, wherein the body is formed from a combination of bubble material and an organic-based pore forming agent. The organic-based pore forming agent can be walnut shell.

In certain embodiments, the mixture used to form the bonded abrasive body can include a pore forming agent in an amount of at least about 1 wt % for the total weight of the mixture. In other instances, the content of pore forming agent in the mixture can be at least about 2 wt %, such as at least about 3 wt %, at least about 4 wt %, or even at least about 5 wt %. Still, the total content of the pore forming agent in the mixture can be not greater than about 15 wt %, not greater than about 12 wt %, not greater than about 10 wt %, or even not greater than about 9 wt % for the total weight of the mixture. It will be further appreciated that the total content of the pore forming agent within the mixture to form the bonded abrasive body can be within a range between any of the minimum and maximum percentages noted above.

After the mixture is suitably formed, the mixture can be shaped. Suitable shaping processes can include casting, molding, pressing, extrusion, and a combination thereof. In particular instances, shaping includes pressing operations and/or molding operations, and a combination thereof. For example, in one embodiment, the mixture can be shaped by cold pressing the mixture within a mold to form a green body.

After suitably forming the green body, the green body can be fired at a particular temperature to facilitate forming an abrasive article having a suitable bond material. Notably, for embodiments herein utilizing a vitreous phase bond material, the firing operation can be conducted at a firing temperature that is not greater than about 900° C. In particular embodiments, the firing temperature can be less, such as not greater than about 860° C., not greater than about 840° C., not greater than about 800° C., not greater than about 780° C., or even not greater than about 760° C. Still, the firing temperature may be at least about 400° C., at least about 500° C., or even at least about 600° C. It will be appreciated that particularly low firing temperatures may be utilized with the above-noted bond components such that excessively high temperatures are avoided and thus limiting the degradation of the abrasive particles during the forming process.

According to one particular embodiment, the bonded abrasive body comprises a bond material having a vitreous phase material. In particular instances, the bond material can be a single phase vitreous material. Moreover, the bond material may be essentially free of crystalline material.

The finally-formed bonded abrasive body can have a particular content of bond material, abrasive particles, and porosity that may facilitate improved performance. For example, the body of the bonded abrasive article can have a porosity of at least about 5 vol % for the total volume of the bonded abrasive body. In other embodiments, the amount of porosity can be greater such as at least about 10 vol %, such as at least about 15 vol %, at least about 20 vol %, at least about 24 vol %, at least about 28 vol %, at least about 30 vol %, or even at least about 32 vol %, for the total volume of the bonded abrasive body. In accordance with an embodiment, the bonded abrasive body can have a porosity that is not greater than about 70 vol %, such as not greater than about 65 vol %, not greater than about 63 vol %, not greater than about 60 vol %, or even not greater than about 58 vol % for the total volume of the bonded abrasive body. It will be appreciated that the bonded abrasive body can have a porosity within a range between any of the minimum and maximum percentages noted above.

Furthermore, in particular instances, the bonded abrasive body can have a portion of the porosity that is interconnected porosity, wherein interconnected porosity is defined as an interconnected network of channels extending through the body and open to the external surface of the bonded abrasive body. According to one embodiment, at least about 5% of the total volume of porosity is interconnected porosity. In other instances, the content of interconnected porosity can be greater, such as at least about 10%, at least about 20%, at least about 30%, at least about 40%, or even at least about 50% of the total porosity. Still, in particular embodiments, the amount of interconnected porosity may be not greater than about 95%, such as not greater than about 90%, or even not greater than about 85% of the total volume of porosity. It will be appreciated that the bonded abrasive body can have a content of interconnected porosity within a range between any of the minimum and maximum percentages noted above.

In an embodiment, the bonded abrasive body can contain a minor content (vol %) of bond material as compared to the content of porosity and abrasive particles. For example, the bonded abrasive body can have not greater than about 50 vol % bond material for the total volume of the bonded abrasive body. In other instances, the bonded abrasive body can be formed such that it contains not greater than about 46 vol %, not greater than about 42 vol %, not greater than about 36 vol %, not greater than about 32 vol %, not greater than about 26 vol %, not greater than about 22 vol %, or even not greater than about 18 vol % bond material for the total volume of the bonded abrasive body. In one particular instance, the bonded abrasive body can have at least about 1 vol %, such as at least about 2 vol %, at least about 3 vol %, at least about 4 vol %, at least about 6 vol %, or even at least about 10 vol % bond material for the total volume of the bonded abrasive body. It will be appreciated that the bonded abrasive body can have a content of bond material within a range between any of the minimum and maximum percentages noted above.

In accordance with an embodiment, the bonded abrasive body can have a total content of abrasive particles of at least about 10 vol % for the total volume of the bonded abrasive body. In certain other instances, the total content of abrasive particles in the bonded abrasive body can be greater, such as at least about 15 vol %, at least about 20 vol %, at least about 25 vol %, at least about 30 vol %, at least about 32 vol %, at least about 34 vol %, or even at least about 36 vol % abrasive particles for the total volume of the bonded abrasive body. In accordance with another particular embodiment, the bonded abrasive body can be formed such that it has not greater than about 80 vol %, not greater than about 70 vol %, not greater than about 65 vol %, not greater than about 60 vol %, not greater than about 55 vol %, not greater than about 50 vol %, not greater than about 45 vol %, or even not greater than about 42 vol % abrasive particles for the total volume of the bonded abrasive body. It will be appreciated that the content of abrasive particles within the bonded abrasive body can be within a range between any of the minimum and maximum percentages noted above.

It will be reasonably understood that the total content of the component phases (e.g., abrasive particulate material, porosity, bond, fillers, etc.) of the bonded abrasive body add up to, and do not exceed, 100%.

The bonded abrasive article can include a bond material configured to have a particular melting point. In one embodiment the melting point of the bond material can be not greater than about 1200° C., such as not greater than about 1100° C., or even not greater than about 1000° C. Still, the melting point of the bond material can be at least about 500° C., such as at least about 600° C., or even at least about 700° C. It will be appreciated that the melting point of the bond material may be within a range between any of the maximum and minimum temperatures noted above.

The bonded abrasive article can include a bond material configured to have a particular glass transition temperature. In one embodiment the glass transition temperature of the bond material can be not greater than about 800° C., such as not greater than about 700° C., or even not greater than about 600° C. Still, the glass transition temperature of the bond material can be at least about 350° C., such as at least about 400° C., or even at least about 450° C. It will be appreciated that the glass transition temperature of the bond material may be within a range between any of the maximum and minimum temperatures noted above.

The bonded abrasive article can include a bond material configured to have a particular softening point temperature. In one embodiment, the softening point temperature of the bond material can be not greater than about 800° C., such as not greater than about 700° C., or even not greater than about 600° C. Still, the softening point temperature of the bond material can be at least about 300° C., such as at least about 400° C., or even at least about 500° C. It will be appreciated that the softening point temperature of the bond material may be within a range between any of the maximum and minimum temperatures noted above.

The bonded abrasive bodies of the embodiments herein can have certain physical properties. For example, the bonded abrasive body can have an elastic modulus of at least about 20 gigapascal (GPa), for a structure having an amount of abrasive particles in a range between about 46 vol % and about 50 vol %, and a bond material in a range between about 7 vol % and about 11 vol % and a remainder amount of porosity. In an embodiment, the elastic modulus of the bonded abrasive body can be greater, such as at least about 25 GPa, at least about 30 GPa, at least about 35 GPa, at least about 40 GPa, or even at least about 45 GPa. Still, the elastic modulus of the bonded abrasive body may be not greater than about 100 GPa, such as not greater than about 80 GPa, or even not greater than about 60 GPa. It will be appreciated that the elastic modulus of the bonded abrasive body can be within a range between any of the maximum and minimum values noted above. It will be appreciated that the elastic modulus (E-Mod) of bars were measured from the Grindosonic (J.W. Lemmens INC, Bridgeton, Mo.) reading and the calculated density.

According to another aspect, the bonded abrasive body can have a Sand Blast Hardness (SBH) of at least about 1 mm, for a structure having an amount of abrasive particles in a range between about 46 vol % and about 50 vol %, and a bond material in a range between about 7 vol % and about 11 vol %, and a remainder amount of porosity.

In an embodiment, the SBH of the bonded abrasive body can be greater, such as at least about 1.2 mm, or even at least about 1.5 mm. Still, the SBH of the bonded abrasive body may be not greater than about 5 mm, or even not greater than about 4 mm. It will be appreciated that the SBH of the bonded abrasive body can be within a range between any of the maximum and minimum values noted above. It will be appreciated that the sandblast tests were conducted using the following procedure: by first calibrating a standard, such as a glass plate material, on a table under a measuring rod and the standard was placed in contact with a surface of the blast seal. An air pressure of 15 psi, in a chamber having a volume of 48 cc was used to blast standard grade sand material at the surface of the standard (or samples) for a single cycle time of 10 seconds. The depth of the hole formed in the standard after a single cycle was measured and recorded. Upon confirming the depth of the hole formed in the standard was within the appropriate range, samples formed according to embodiments herein were tested. As will be appreciated, the lower the value of the depth, the harder the abrasive article.

In yet another embodiment, the bonded abrasive body can have a modulus of rupture (MOR) of at least about 15 megapascals (MPa), for a structure having an amount of abrasive particles in a range between about 46 vol % and about 50 vol %, a bond material in a range between about 7 vol % and about 11 vol %, and a remainder amount of porosity. In an embodiment, the MOR of the bonded abrasive body can be greater, such as at least about 18 MPa, at least about 20 MPa, or even at least about 25 MPa. Still, the MOR of the bonded abrasive body may be not greater than about 50 MPa, or even not greater than about 45 MPa. It will be appreciated that the elastic modulus of the bonded abrasive body can be within a range between any of the maximum and minimum values noted above. It will be appreciated that the MOR was measured on the test bars in 4 point bending on an Instron machine. It will be appreciated that the load cell used was 10 kilonewtons (kN) and the speed test used was 0.05 inches/min.

Reference herein to the grinding capabilities of the bonded abrasive body can relate to grinding operations such as centerless grinding, cylindrical grinding, crankshaft grinding, various surface grinding operations, bearing and gear grinding operations, creepfeed grinding, and various toolroom grinding processes. Moreover, suitable workpieces for the grinding operations can include inorganic or organic materials. In particular instances, the workpiece can include a metal, metal alloy, plastic, or natural material. In one embodiment, the workpiece can include a ferrous metal, non-ferrous metal, metal alloy, metal superalloy, and a combination thereof. In another embodiment, the workpiece can include an organic material, including for example, a polymer material. In still other instances, the workpiece may be a natural material, including for example, wood.

According to another embodiment, the abrasive particles can be shaped abrasive particles. Shaped abrasive particles can have a well-defined and regular arrangement (i.e., non-random) of edges and sides, thus defining an identifiable shape. For example, a shaped abrasive particle may have a polygonal shape as viewed in a plane defined by any two dimensions of length, width, and height. Some exemplary polygonal shapes can be triangular, quadrilateral (e.g., rectangular, square, trapezoidal, parallelogram), a pentagon, a hexagon, a heptagon, an octagon, a nonagon, a decagon, and the like. Additionally, the shaped abrasive particle can have a three-dimensional shape defined by a polyhedral shape, such as a prismatic shape or the like. Further, the shaped abrasive particles may have curved edges and/or surfaces, such that the shaped abrasive particles can have convex, concave, ellipsoidal shapes.

The shaped abrasive particles can be in the form of any alphanumeric character, e.g., 1, 2, 3, etc., A, B, C. etc. Further, the shaped abrasive particles can be in the form of a character selected from the Greek alphabet, the modern Latin alphabet, the ancient Latin alphabet, the Russian alphabet, any other alphabet (e.g., Kanji characters), trademarks indicia, symbols, and any combination thereof.

The shaped abrasive particle can have a body defining a length (l), a height (h), and a width (w), wherein the length is greater than or equal to the height, and the height is greater than or equal to the width. Further, in a particular aspect, the body may include a primary aspect ratio defined by the ratio of length:height of at least about 1:1. The body may also include an upright orientation probability of at least about 50%.

In another aspect, the shaped abrasive particle can have a body having a length (l), a width (w), and a height (h), wherein the length, width, and height may correspond to a longitudinal axis, a lateral axis, and a vertical axis, respectively, and the longitudinal axis, lateral axis, and vertical axis may define three perpendicular planes. In this aspect, the body may include an asymmetric geometry with respect to any of the three perpendicular planes.

In yet another aspect, the shaped abrasive particle may include a body having a complex three-dimensional geometry including 3-fold symmetry in three perpendicular planes defined by a longitudinal axis, a lateral axis, and a vertical axis. Further, the body may include an opening that extends through the entire interior of the body along one of the longitudinal axis, lateral axis, or vertical axis.

In still another aspect, the shaped abrasive particle may include a body having a complex three-dimensional geometry defined by a length (l), a width (w), and a height (h). The body may also include a center of mass and a geometric midpoint. The center of mass may be displaced from the geometric midpoint by a distance (Dh) of at least about 0.05 (h) along a vertical axis of the body defining the height.

In another aspect, the shaped abrasive particle may include a body that defines a length (l), a width (w), and a height (h). The body may include a base surface and an upper surface. Further, the base surface comprises a different cross-sectional shape than a cross-sectional shape of the upper surface.

In still another aspect, the shaped abrasive particle may include a body that has a generally flat bottom and a dome shaped top extending from the generally flat bottom.

In another aspect, the shaped abrasive particle may include a body comprising a length (l), a width (w), and a height (h). The length, width, and height may correspond to a longitudinal axis, a lateral axis, and a vertical axis, respectively. Further, the body may include a twist along a longitudinal axis defining the length of the body such that a base surface is rotated with respect to an upper surface to establish a twist angle.

In yet another aspect, the shaped abrasive particle may include a body having a first end face and a second end face, at least three adjacent side faces extending between the first end face and the second end face, and an edge structure established between each pair of adjacent side faces.

In another aspect, the shaped abrasive particle may include a body having a central portion and at least three radial arms extending outwardly from the central portion along the entire length of the central portion.

EXAMPLES

Example 1

FIG. 1 includes a plot of power versus time at three different feed rates, for a conventional bonded abrasive article and two sample abrasive articles formed according to embodiments herein. Plot 101 represents the performance of Sample 1, a bonded abrasive article formed according to an embodiment herein. Sample 1 is a bonded abrasive body having a porosity of approximately 42 vol % to approximately 56 vol %, an abrasive particle content (i.e., microcrystalline alumina particles) within a range between about 42 vol % and about 52 vol %, and a bond material content within a range between about 6 vol % and about 14 vol %. Sample 1 is cold pressed and fired at a temperature of approximately 750° C. The bond material is formed from a mixture having the composition of bond material components as provided in weight percent for the total weight of the mixture given in Table 1 below. It will be appreciated that the total content of bond material components add up to 100%.

TABLE 1

| | |
|---|---|
| $SiO_2$ | 16-19 |
| $Al_2O_3$ | 1-3 |
| $TiO_2$ | Trace |
| CaO | <1 |
| MgO | <1 |
| $Li_2O$ | <1 |
| Na2O | <1 |
| $K_2O$ | <1 |
| $Bi_2O_3$ | 15-18 |
| BaO | 32-38 |
| ZnO | 8-11 |
| $B_2O_3$ | 19-23 |

Plot 102 represents a performance of Sample 2, a bonded abrasive article formed according to an embodiment herein. Sample 2 is a bonded abrasive body having a porosity of approximately 42 vol % to approximately 56 vol %, an abrasive particle content (i.e., microcrystalline alumina particles) within a range between about 42 vol % and about 52 vol %, and a bond material content within a range between about 6 vol % and about 14 vol %. Sample 2 is formed by cold pressing the mixture to form a shaped green article and firing the green article at a temperature of approximately 750° C. The bond material is formed from a mixture having the composition of bond material components as provided in weight percent for the total weight of the mixture given in Table 2 below. It will be appreciated that the total content of bond material components add up to 100%.

TABLE 2

| | |
|---|---|
| $SiO_2$ | 8-12 |
| $Al_2O_3$ | 2-4 |
| $TiO_2$ | Trace |
| CaO | <1 |
| MgO | <1 |
| $Li_2O$ | <1 |
| $Na_2O$ | <1 |
| $K_2O$ | <1 |
| $Bi_2O_3$ | 15-18 |
| BaO | 36-40 |
| ZnO | 8-11 |
| $B_2O_3$ | 20-24 |

Plot 103 represents a performance of conventional sample 1 (CS1), a bonded abrasive article formed according to conventional techniques. Sample CS1 is a bonded abrasive body having a porosity of approximately 42 vol % to approximately 56 vol %, an abrasive particle content (i.e., microcrystalline alumina particles) within a range between about 42 vol % and about 52 vol %, and a bond material content within a range between about 6 vol % and about 14 vol %. Sample CS1 is formed by cold pressing the mixture to form a shaped green article and firing the green article at a temperature of approximately 900° C. The bond material is formed from a mixture having the composition of bond material components as provided in weight percent for the total weight of the mixture given in Table 3 below. It will be appreciated that the total content of bond material components add up to 100%.

TABLE 3

| | |
|---|---|
| $SiO_2$ | 55-58 |
| $Al_2O_3$ | 12-14 |
| $Fe_2O_3$ | Trace (<0.5%) |
| $TiO_2$ | <0.5 |
| $L_{i2}O$ | 2-5 |
| $Na_2O$ | 9-11 |
| $K_2O$ | <1 |
| $B_2O_3$ | 15-16 |

TABLE 3-continued

| | |
|---|---|
| RO | <1 |
| $R_2O$ | 10-15 |

Samples 1 and 2 were tested in a wet OD Plunge grinding operation and power consumption surface finish (a measure of part quality), wheel wear, and G ratio were measured during this testing. The test parameters are shown below.

| METHOD OF THE TEST | |
|---|---|
| Machine | Bryant OD/ID Grinder LL3 |
| Wheel Speed | 6497 R.P.M. |
| Work speed | 150 R.P.M. |
| Grinding Mode | Wet O.D. Plunge (Climb) |
| Infeed Rate ($in^3$/mn/in) | 0.3 |
| | 0.6 |
| | 1.0 |
| Coolant | Trim-E812 at 5% ratio with deionized well water |

| MATERIAL TYPE | SIZE | LOT NUMBER | HARDNESS |
|---|---|---|---|
| 52100 | 3.420" × .250" | 295 | 61 HRC |

As illustrated in FIG. 1, Samples 1 and 2 have comparable power requirements per time of grinding as compared to sample CS1. It is notable that over the range of different feed rates tested, despite having a lower firing temperature, Samples 1 and 2 performed as well as sample CS1. In fact, Sample 1 demonstrated lower power requirements for all feed rates tested, demonstrating improved performance compared to the convention sample CS1.

Figure 2:
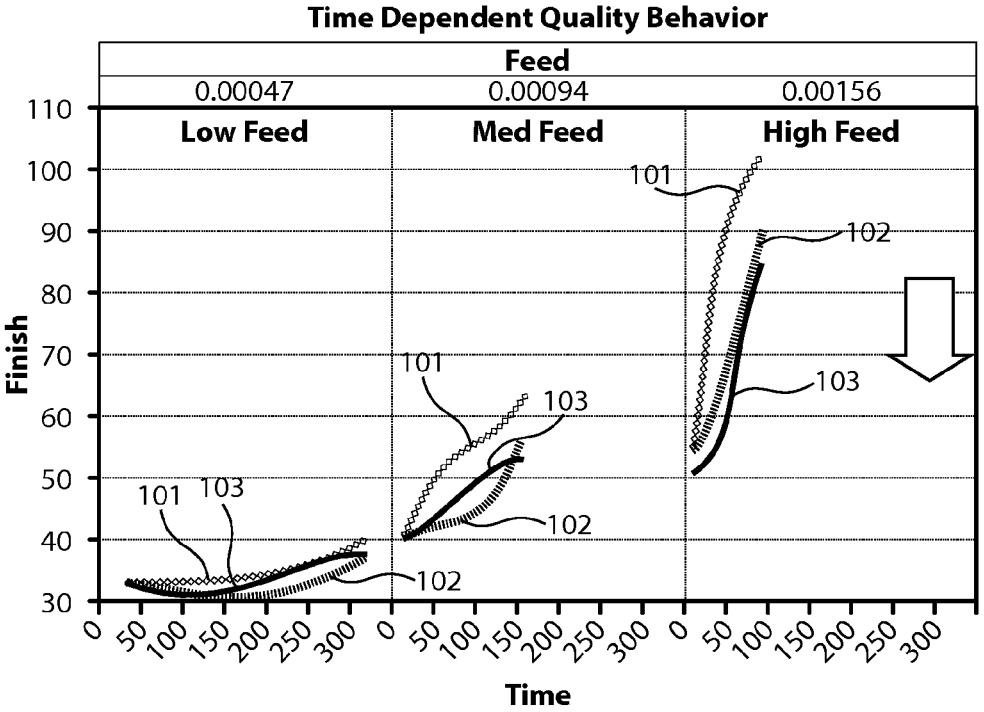
FIG. 2 includes a plot of finish (Ra) versus time at three different feed rates, for a conventional bonded abrasive article and abrasive articles according to embodiments.

Surface finish is a measure of part quality, and it is measured using a System 5000 that has a 1μ minimum division. FIG. 2 includes a plot of finish (Ra) versus time at three different feed rates for the conventional bonded abrasive sample CS1 and sample abrasive articles, Sample 1 and Sample 2, formed according to the embodiments. As illustrated, Samples 1 and 2 had essentially the same performance as comparative sample, CS1.

Figure 3:
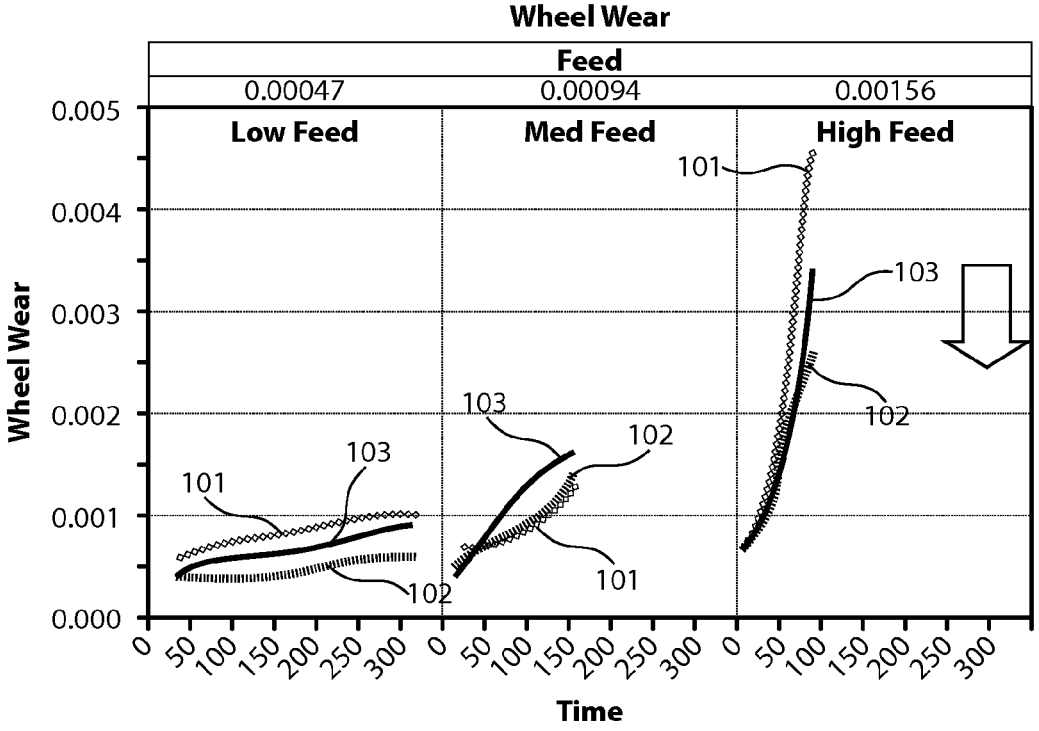
FIG. 3 includes a plot of cumulative wheel wear (inches) versus time at three different feed rates, for a conventional bonded abrasive article and abrasive articles according to embodiments.

Wheel wear was measured using a dial indicator that has a minimum division of 0.0001 inches. FIG. 3 includes a plot of cumulative wheel wear (in inches) versus time at three different feed rates, for the conventional bonded abrasive sample (CS1) and sample abrasive articles (Samples 1 and 2) according to embodiments. As illustrated, Samples 1 and 2 demonstrated essentially the same performance as comparative sample, CS1. In fact, at certain feed rates, Sample 1 or Sample 2 performed better than conventional sample, CS1.

Figure 4:
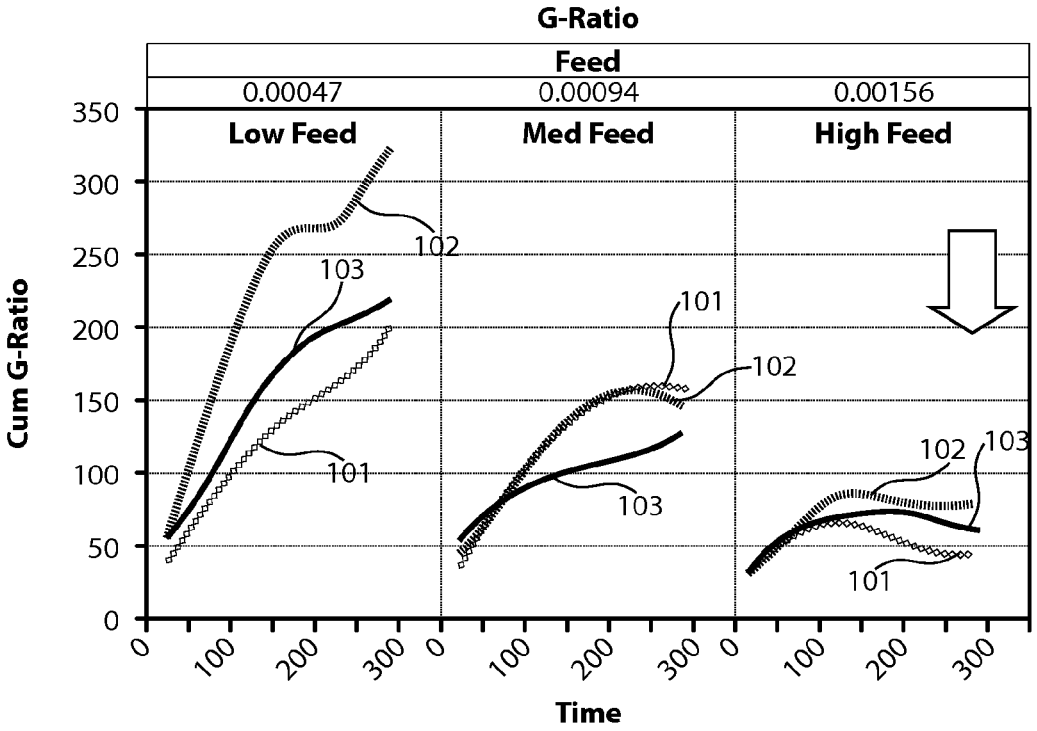
FIG. 4 includes a plot of cumulative G-ratio versus cumulative material removed at three different feed rates, for a conventional bonded abrasive article and abrasive articles according to embodiments.

The G-ratio was calculated from the wheel wear and the material removed measurements. FIG. 4 includes a plot of cumulative G-ratio versus cumulative material removed at three different feed rates, for the conventional bonded abrasive sample (CS1) and the sample abrasive articles formed according to the embodiments (Sample 1 and Sample 2). As illustrated, Samples 1 and 2 demonstrated essentially the same performance as comparative sample, CS1. Moreover, at certain feed rates, Sample 1 or Sample 2 performed better than conventional sample, CS1.

Figure 5:
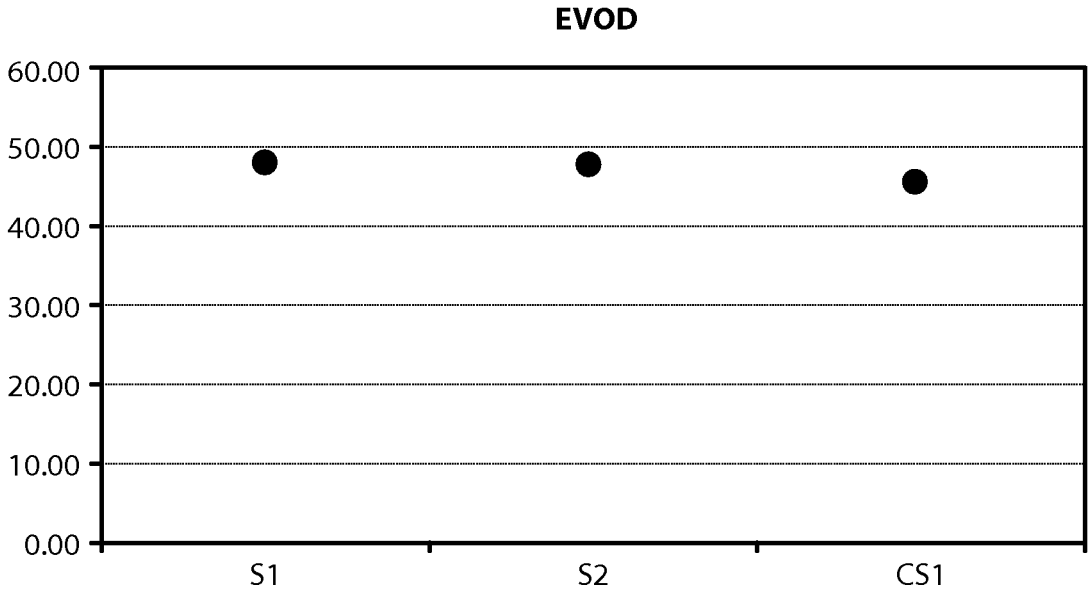
FIG. 5 includes a plot of elastic modulus for a conventional bonded abrasive article and abrasive articles according to embodiments.
Figure 6:
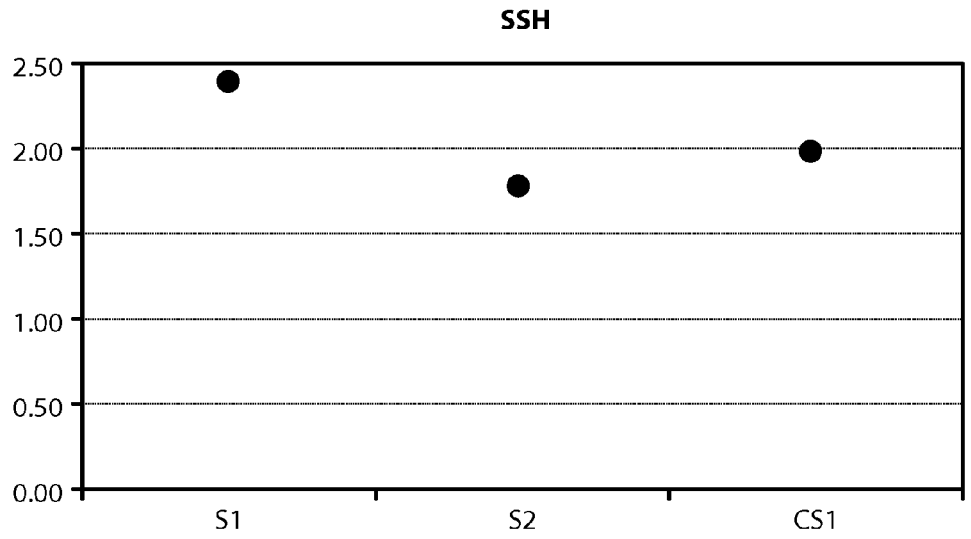
FIG. 6 includes a plot of Sand Blast Hardness, or SBH, (mm) for a conventional bonded abrasive article and abrasive articles according to embodiments.
Figure 7:
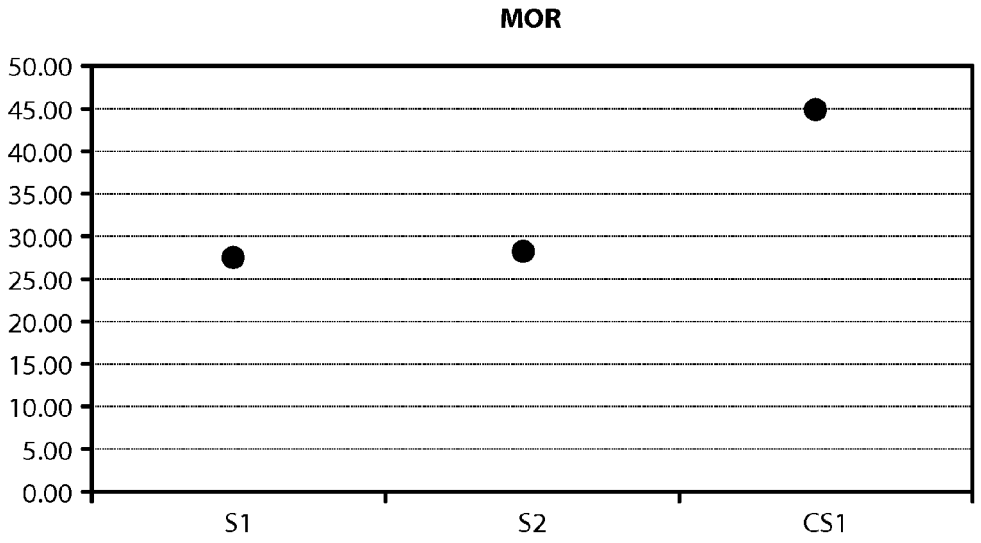
FIG. 7 includes a plot of modulus of rupture for a conventional bonded abrasive article and abrasive articles according to embodiments.

Elastic modulus (E-Mod) was measured from the Grindosonic reading and the calculated density. FIG. 5 includes a plot of elastic modulus for a conventional bonded abrasive sample (CS1) and sample abrasive articles formed according to embodiments (Sample 1 and Sample 2). As illustrated, Samples 1 and 2 had essentially the same elastic modulus as comparative sample, CS1, despite having been formed at a significantly lower firing temperature FIG. 6 includes a plot of SBH (mm) for the conventional bonded abrasive sample (CS1) and sample abrasive articles (Sample 1 and Sample 2). As illustrated, Samples 1 and 2 have comparable SBH as compared to comparative sample, CS1, despite having been formed at a significantly lower firing temperature. Sandblast hardness measurements were made by measuring the depth of the hole generated when an air pressure of 15 psi, in a chamber having a volume of 48 cc, was used to blast standard grade sand material at the surface of the sample for a single cycle time of 10 seconds. FIG. 7 includes a plot of modulus of rupture (MOR) for a conventional bonded abrasive article (CS1) and sample abrasive articles (Sample 1 and Sample 2). As illustrated, Samples 1 and 2 have only slightly lower MOR as compared to comparative sample, CS1. MOR was measured using a 4-point bend test set-up in an Instron machine.

The foregoing embodiments are directed to abrasive products, and particularly bonded abrasive products, which represent a departure from the state-of-the-art. As described in the present application, the bonded abrasive bodies of the embodiments herein utilize a combination of non-limiting features including a particular amount and type of abrasive particles, particular amount and type of bond material, and a particular amount of porosity. Notably, the bond material can be formed from a mixture of a particular combination of materials, including but not limited to boron oxide, barium oxide, bismuth oxide, and zinc oxide. Surprisingly, the bond material facilitates lower firing temperatures while having comparable grinding performance relative to state-of-the-art abrasive articles.

In the foregoing, reference to specific embodiments and the connections of certain components is illustrative. It will be appreciated that reference to components as being coupled or connected is intended to disclose either direct connection between said components or indirect connection through one or more intervening components as will be appreciated to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description, with each claim standing on its own as defining separately claimed subject matter.

What is claimed is:

1. An abrasive article comprising:

a bonded abrasive body comprising abrasive particles contained within a bond material, the bond material comprising a vitreous material formed from a mixture including aluminum oxide ($Al_2O_3$), bismuth oxide ($Bi_2O_3$), and boron oxide ($B_2O_3$), wherein the mixture comprises an amount (wt %) of aluminum oxide less than an amount (wt %) of bismuth oxide and the amount (wt %) of aluminum oxide is less than an amount (wt %) of boron oxide, wherein the mixture comprises at least about 10 wt % bismuth oxide ($Bi_2O_3$), and wherein the bond material comprises a single phase vitreous material.

2. The abrasive article of claim 1, wherein the bond material comprises a glass transition temperature of not greater than about 600° C.

3. The abrasive article of claim 1, wherein the mixture comprises bismuth oxide and aluminum oxide in a ratio ($Bi_2O_3/Al_2O_3$) of at least about 1.2 and not greater than about 40.

4. The abrasive article of claim 1, wherein the mixture comprises boron oxide ($B_2O_3$), wherein the mixture comprises boron oxide and aluminum oxide in a ratio ($B_2O_3/Al_2O_3$) of at least about 3 and not greater than about 30.

5. The abrasive article of claim 1, wherein the mixture comprises silicon dioxide ($SiO_2$) and boronoxide ($B_2O_3$), wherein the mixture comprises boron oxide and silicon dioxide in a ratio ($B_2O_3/SiO_2$) of at least about 0.5 and not greater than about 10.

6. The abrasive article of claim 1, wherein the mixture comprises silicon dioxide ($SiO_2$), wherein the mixture comprises bismuth oxide and silicon dioxide in a ratio ($Bi_2O_3/SiO_2$) of at least about 0.5 and not greater than about 10.

7. The abrasive article of claim 1, wherein the mixture comprises silicon dioxide ($SiO_2$) and barium oxide (BaO), wherein the mixture comprises barium oxide and silicon dioxide in a ratio ($BaO/SiO_2$) of at least about 0.5.

8. An abrasive article comprising:

a bonded abrasive body a bonded abrasive body comprising abrasive particles including microcrystalline alumina, the abrasive particles contained within a bond material comprising a vitreous material formed from a mixture comprising barium oxide (BaO), boron oxide ($B_2O_3$) and silicon dioxide ($SiO_2$), wherein the mixture comprises at least about 12 wt % barium oxide (BaO), wherein the mixture comprises a ratio of barium oxide to silicon dioxide ($BaO/SiO_2$) of at least about 1.2 and wherein the mixture comprises boron oxide and aluminum oxide in a ratio ($B_2O_3/Al_2O_3$) of at least about 3 and not greater than about 30.

9. The abrasive article of claim 8, wherein the bond material comprises a glass transition temperature of not greater than about 600° C.

10. The abrasive article of claim 8, wherein the bond material comprises a softening point temperature of not greater than about 600° C.

* * * * *